United States Patent [19]

Barkan et al.

[11] 4,118,613

[45] Oct. 3, 1978

[54] HYDRAULICALLY-ACTUATED OPERATING SYSTEM FOR AN ELECTRIC CIRCUIT BREAKER

[75] Inventors: Philip Barkan, Media; Imdad Imam, Secane, both of Pa.

[73] Assignee: General Electric Company, Philadelphia, Pa.

[21] Appl. No.: 810,663

[22] Filed: Jun. 27, 1977

[51] Int. Cl.[2] ..... H01H 35/38

[52] U.S. Cl. ..... 200/82 B; 200/148 B; 60/413

[58] Field of Search ..... 200/148 R, 148 B, 82 R, 200/82 B, 337; 60/407, 412, 413, 418

[56] References Cited

U.S. PATENT DOCUMENTS

| | | | |
|---|---|---|---|
| 2,740,859 | 4/1956 | Beatty | 200/82 B |
| 3,334,202 | 8/1967 | Tognella | 200/82 B |
| 4,041,264 | 8/1977 | Grune | 200/82 B |

*Primary Examiner*—Gerald P. Tolin
*Attorney, Agent, or Firm*—William Freedman

[57] ABSTRACT

This hydraulically-actuated operating system comprises a cylinder, a piston movable therein in an opening direction to open a circuit breaker, and an accumulator for supplying pressurized liquid to a piston-actuating space within the cylinder. A normally-closed valve between the accumulator and the actuating space is openable to allow pressurized liquid from the accumulator to flow through the valve into the actuating space to drive the piston in an opening direction. A vent is located hydraulically between the actuating space and the valve for affording communication between said actuating space and a low pressure region.

Flow control means is provided for restricting leakage through said vent to a rate that prevents said leakage from substantially detracting from the development of pressure within said actuatng space during the period from initial opening of the valve to the time when said piston has moved through most of its opening stroke. Following such period and while the valve is still open, said flow control means allows effective leakage through said vent. The accumulator has a limited capacity that results in the pressure within said actuating space decaying promptly to a low value as a result of effective leakage through said vent after the piston has moved through a circuit-breaker opening stroke and while the valve is in its open state. Means is provided for resetting the valve to its closed state in response to said pressure decay in the actuating space.

18 Claims, 4 Drawing Figures

16
12
14
10
24
34
20
22
36
17
ACCUMULATOR
50
TO SUMP
92
68
30
64
76
56
74
39
80
58
82
62
75
38
72
55
84
72
32
70
65
64
60
42
83
92
TO SUMP
40
85
100
90
106
PUMP
84'
86
104
88

HYDRAULICALLY-ACTUATED OPERATING SYSTEM FOR AN ELECTRIC CIRCUIT BREAKER

The Government of the United States of America has rights in this invention pursuant to Contract No. EX-76-C-01-2065 awarded by the U.S. Energy Research and Development Administration.

BACKGROUND

This invention relates to a hydraulically-actuated operating system for operating an electric circuit breaker and, more particularly, relates to high speed, relatively simple valve means for controlling opening and closing of the circuit breaker.

The usual hydraulic operating system for producing high-speed operation and control of a circuit breaker typically comprises a main valve and a pilot valve for controlling the main valve. Typically, the pilot valve must be operated from a normal to an operated position to initiate operation of the main valve, which, in turn, initiates operation of the circuit breaker, and must then return to its normal position at the end of the circuit-breaker operation to restore the main valve to its initial position so as to prepare the system for operation of the circuit breaker in a reverse direction. This type of pilot valve operation requires rather involved controls, either electrical or hydraulic. Moreover, the need to first operate the pilot valve tends to increase the time required from the initial starting signal to operation of the main valve.

SUMMARY

An object of our invention is to effect high-speed circuit-breaker operation and control with a hydraulic operating system comprising a main valve that requires no pilot valve for its control and which requires only an initial starting pulse to produce high-speed circuit-breaker operation followed by resetting of the main valve at the end of the circuit-breaker operation.

Typically, in prior hydraulic operating systems, the main valve referred to hereinabove is a three-way valve, which is generally more complicated and expensive than a comparable two-way valve.

Another object is to carry out the preceding object with a hydraulic operating system that employs a two-way main valve and does not require a three-way main valve.

Another object is to provide a hydraulic operating system that is capable of effecting especially high-speed opening of a circuit breaker following an initial starting signal.

In carrying out our invention in one form, we provide, for operating a circuit breaker, a hydraulically-actuated operating system that comprises a fluid motor including a cylinder and a movable piston adapted to move through an opening stroke within the cylinder to open the circuit breaker and in a reverse direction within the cylinder during closing of the circuit breaker. An accumulator is provided for supplying pressurized liquid to an actuating space within the cylinder, and a normally-closed valve located hydraulically between the accumulator and the actuating space can be opened to establish communication between the accumulator and the actuating space so that pressurized liquid from the accumulator can flow through said valve to the actuating space to drive the piston through its opening stroke. The valve comprises a movable valve member that is movable from a valve-closed to a valve-open position to open the valve and is returnable to the valve-closed position to close the valve.

A vent located hydraulically downstream of the valve with respect to the accumulator is provided for affording communication between the actuating space and a low pressure region. Flow control means is provided for restricting leakage through said vent to a rate that prevents said leakage from substantially detracting from the development of pressure within said actuating space during the period from initial opening of said valve to the time when said piston has moved through most of its opening stroke. Following such period and while the valve is still open, the flow control means allows effective leakage through said vent. The accumulator has a limited capacity that results in the pressure within the actuating space decaying promptly to a low value as a result of leakage through the vent shortly after the piston has moved through a circuit-breaker opening stroke and while the movable valve member is in its valve-open position. Means is provided for restoring the movable valve member to its closed position in response to said pressure decay in the actuating space.

BRIEF DESCRIPTION OF DRAWINGS

For a better understanding of the invention, reference may be had to the accompanying drawings, wherein.

DETAILED DESCRIPTION OF PREFERRED EMBODIMENTS

Figure 1:
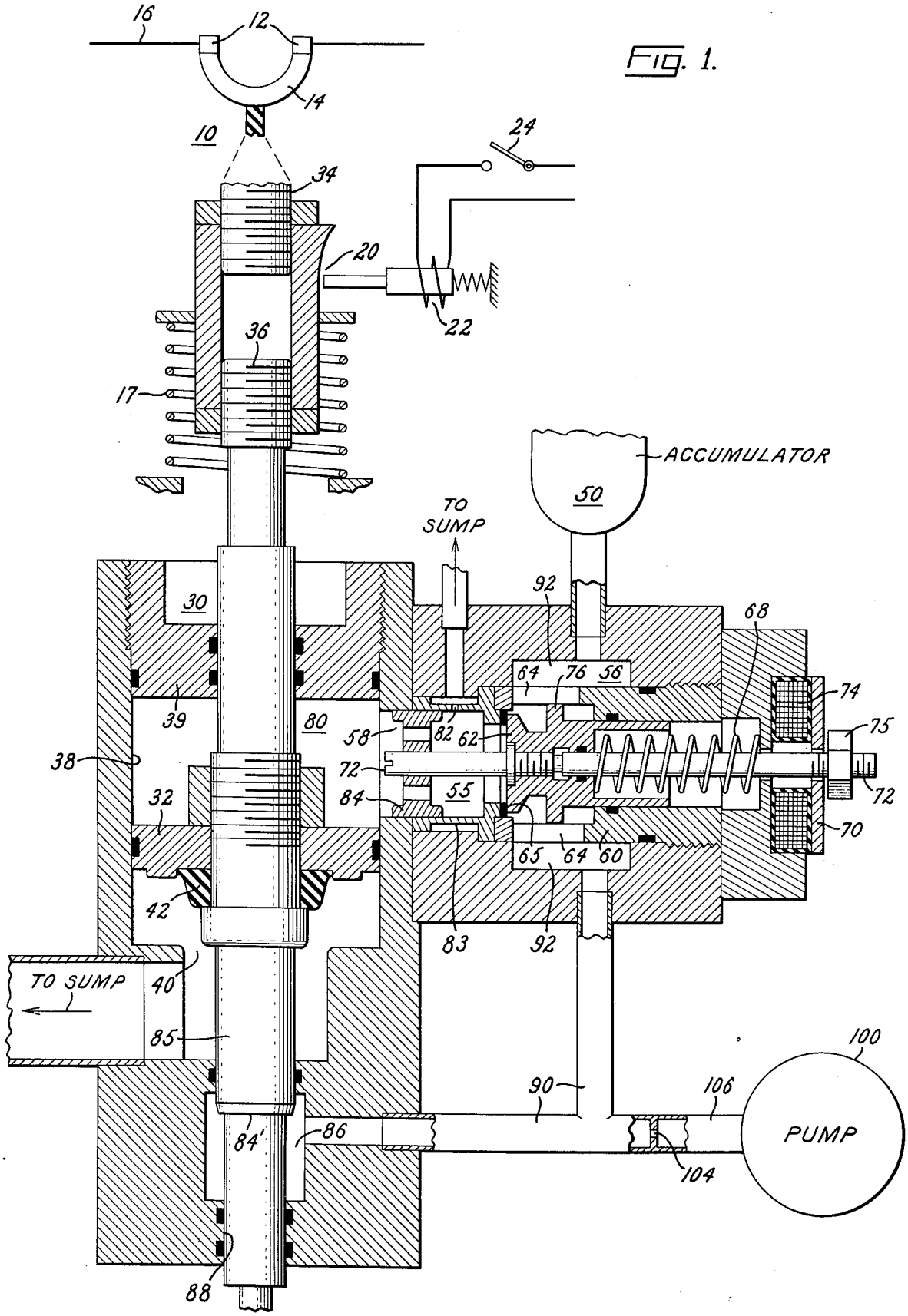
FIG. 1 is a partially schematic sectional view of a circuit breaker including a hydraulic operating system embodying one form of the invention. The circuit breaker is shown in its closed position, and the hydraulic operating system is shown in its normal at-rest condition in which it is prepared to initiate an opening operation of the circuit breaker.

Referring now to FIG. 1, there is shown a circuit breaker 10 comprising a set of separable contacts 12 and 14 for controlling a power circuit 16. The contacts 12 are stationary contacts, and the contact 14 is a movable contact that is biased by means of a suitable closing spring 17 and a small auxiliary fluid motor 84', 86 (to be described) in a direction toward engagement with the stationary contacts. In FIG. 1, the circuit breaker is shown with its contacts engaged and thus in closed position.

Opening of the circuit breaker is effected by driving movable contact 14 downwardly against the bias of closing spring 17 and auxiliary fluid motor 84, 86 to separate contact 14 from stationary contacts 12. When the movable contact 14 reaches its fully-open position, a suitable hold-open latch 20 acts to hold the circuit breaker open. Subsequent closing is effected by releasing the hold-open latch to permit the closing spring 17 and auxiliary motor 84, 86 to return the movable contact 14 upwardly to its closed position. This latch-release is effected by means of a solenoid 22 which is operated by completing an energizing circuit through its coil by closing a closing-control switch 24.

Power for driving the movable contact 14 into its open position during an opening operation is derived from a fluid motor 30 having a piston 32. Piston 32 is coupled to the movable contact 14 through an operating rod that has an insulating portion 34 and a metal portion 36 interconnecting the insulating portion 34 and the piston 32. The fluid motor 30 further comprises a cylinder 38 within which the piston 32 is vertically movable. The upper end of cylinder 38 is closed by an upper end wall 39 through which the piston rod portion 36 slidably extends in sealed relationship. The lower end wall of the cylinder 38 contains a central opening 40 through which a lower portion of the operating rod 34, 36 extends. A plug 42 on the operating rod is adapted to enter the opening 40 as the piston nears the end of its downward opening stroke, thereby restricting the flow of the liquid ahead of the downwardly-moving piston 32 through the opening 40 and thus providing a dashpotting effect that smoothly terminates downward opening motion of the piston.

Pressurized liquid for driving the piston 32 in a downward opening direction is derived from an accumulator 50. Accumulator 50 is of a conventional design but, for reasons soon to be explained, it has a limited capacity that allows it to supply pressurized liquid for only one complete circuit-breaker opening operation without requiring recharging.

Figure 2:
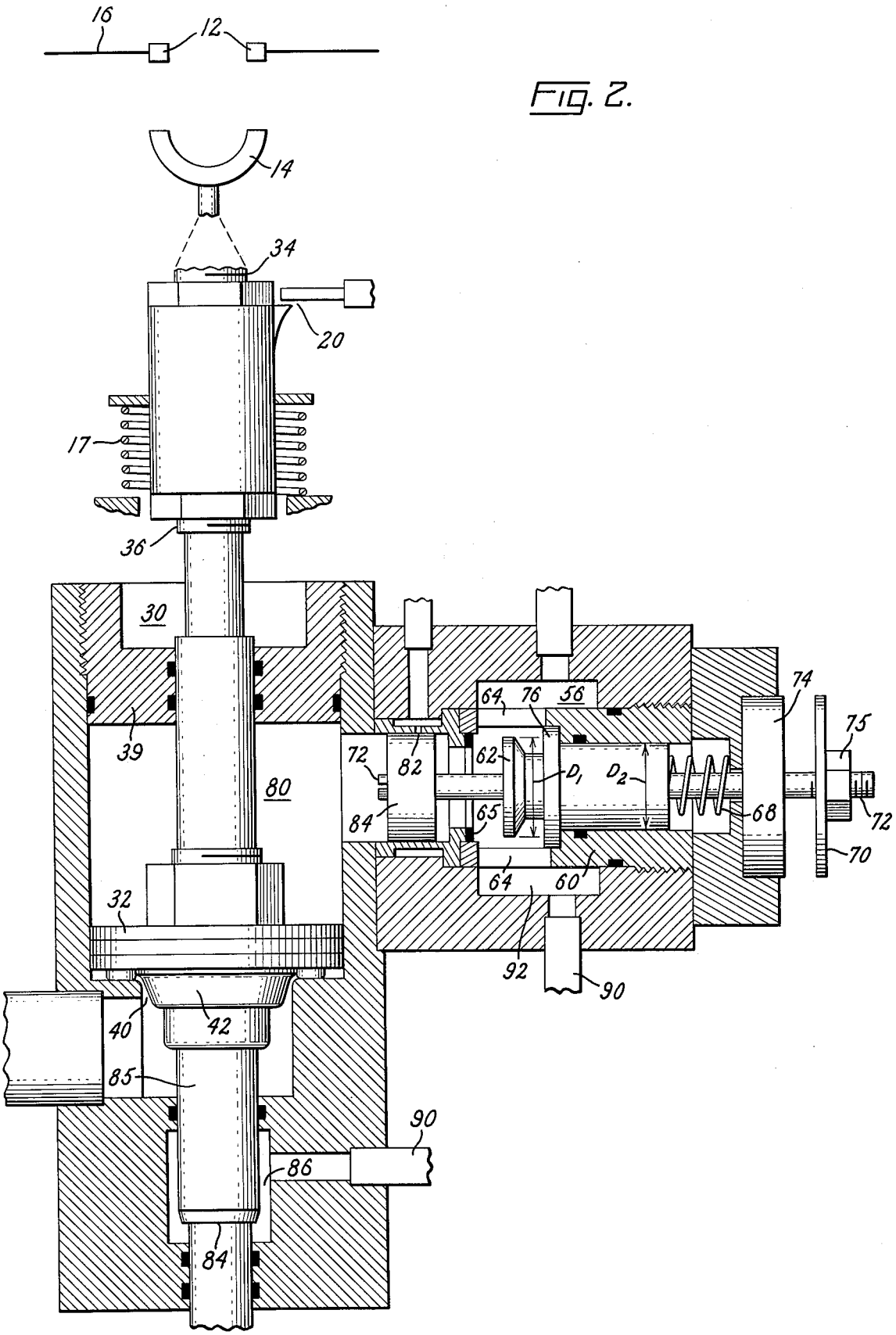
FIG. 2 is a view of the circuit breaker and hydraulic operating system of FIG. 1 at the end of a circuit-breaker opening operation but prior to resetting of the main control valve of the system.

Located hydraulically between the accumulator 50 and the piston 32 is valve means 55 that comprises a main valve 56 and an auxiliary valve 58. The main valve 56 comprises a cylindrical valve body 60 and a movable valve member 62 of the poppet type slidably mounted in the cylindrical valve body. The cylindrical valve body has large ports 64 extending therethrough and a valve seat 65 at its left-hand end against which the movable poppet valve member 62 seats when in its closed position. A compression spring 68 biases the movable valve member 62 into its closed position of FIG. 1, supplementing a slight hydraulic closing bias on the valve member 62 resulting from dimension $D_1$ of the movable main valve member 62 being slightly larger than $D_2$. These dimensions are best seen in FIG. 2.

For actuating the movable valve member 62, we provide a repulsion-type solenoid of a generally conventional design that comprises a stationary coil 74 and an armature 70 coupled to the movable valve member 62 through an operating rod 72. Armature 70 is a disc of highly conductive metal such as copper. The armature is normally held in close proximity to the stationary coil 74 by spring 68 and a nut 75 on rod 72. When the coil 74 is energized by a suitable pulse of current, it develops a magnetic field which induces eddy currents in the armature 70. These eddy currents generate a magnetic field which reacts with the magnetic field created by the coil to produce a rapidly rising repulsion force between the armature and the coil that quickly drives the armature toward the right (toward its position of FIG. 2) against the above-described opposing bias. This movement of the armature 74 to the right acts through nut 75 and operating rod 72 to drive the movable valve member 62 to the right from its position of FIG. 1.

Movement of the valve member 62 from its position of FIG. 1 to the right allows high pressure liquid to immediately flow past the valve seat 65 and build up a high pressure in the actuating space 80 above piston 32. This high pressure liquid also acts on the left-hand face of the movable valve member 62, rapidly providing a high force on valve member 62 that forces it to the right at high speed. When the valve member 62 nears its position of FIG. 2 at the end of its rightward opening stroke, a piston 76 thereon enters the closed end of the valve body, providing a dashpotting effect that smoothly terminates such opening movement of the valve member.

When the valve member 62 is in its closed position of FIG. 1, the actuating space 80 above the circuit-breaker operating piston 32 is at a low pressure, being vented to a low pressure sump through a venting orifice 82 located downstream of the main valve 56 with respect to the accumulator 50. When the main valve member 62 is moved to the right from its closed position of FIG. 1, it carries a flow-controlling auxiliary valve member 84 with it, thereby covering the orifice 82. The flow-controlling auxiliary valve member 84 is a ring that slides in a tubular body 83 containing orifice 82. The orifice 82 is normally unrestricted; but when the ring is moved into alignment with the orifice, the orifice is effectively restricted. It is important to note, however, that despite alignment of the ring 84 with orifice 82, as in FIG. 2, a controlled but limited amount of leakage can still occur through the orifice 82.

The orifice 82 serves to prevent an inadvertent pressure buildup in the actuating space 80 should there be any leakage past movable main valve member 62 when it is in its closed position of FIG. 1. When the movable main valve member 62 is moved a short distance from its position of FIG. 1 toward its open position of FIG. 2 when it is desired to produce operation of the piston 32, the auxiliary ring valve 84 covers the orifice 82 and thus allows pressure in the actuating space 80 to build up very quickly.

Although the auxiliary ring valve allows some leakage through orifice 82 when it covers the orifice, it restricts leakage through the orifice to a rate that prevents said leakage from substantially detracting from the development of pressure within actuating space 80 during the short period (2 or 3 milliseconds) from initial opening of the main valve to the time when the piston 32 has moved through most of its downward opening stroke.

As the piston 32 (after having completed most of its opening stroke) decelerates in response to the above-described dashpotting effect of parts 42, 40, the pressure in actuating space 80 rises; and this increased pressure produces leakage at an increased rate through the then-covered venting orifice 82 (as compared to the rate through the covered orifice during the first portion of the opening stroke).

By providing for this effective leakage through the orifice 82 when the auxiliary valve 84 covers the orifice, we cause excess liquid in the accumulator at the end of a downward operation of piston 32 to flow to the sump through the orifice. This allows pressure to drop in the cylinder's actuating space 80 (after piston 32 has completed its downward opening stroke) which, in turn, allows movable valve members 62 and 84 to return to their normal position of FIG. 1. The movable main valve member 62, in returning to its position of FIG. 1. closes the main valve and thus blocks further communication between the accumulator 50 and the piston actuating space 80. The movable auxiliary valve member 84, in returning to its position of FIG. 1, completely reopens orifice 82 and re-establishes free communication between actuating space 80 and the sump through orifice 82.

To reduce the time required for the desired pressure drop at the end of a downward operation of the piston 32 into its position of FIG. 2, an accumulator (50) is used which has a limited capacity, as has been stated hereinabove. In a preferred form of the invention, this capacity is sufficient to produce only one complete opening operation without recharging of the accumulator. As a result of this limited capacity, leakage through the orifice 82 for only a relatively short time after the piston 32 has completed its downward stroke into its position of FIG. 2 is sufficient to cause the pressure in actuating space 80 to decay to sump pressure.

RECHARGING OF THE ACCUMULATOR

When the pressure in the accumulator 50 falls to a predetermined level, a suitable pump 100 is activated through a conventional pressure-responsive electric switch (not shown) in the accumulator, and the pump responds by forcing high pressure liquid through duct 90 and the space 92 (upstream of the main valve seat 65) into the accumulator. The rate at which pump 100 supplies liquid to the accumulator is controlled by an orifice 104 in a supply line 106 between the pump 100 and the duct 90. This orifice 104 is so small that it limits the rate at which the pump 100 supplies liquid to the accumulator sufficiently so that the pump cannot recharge the accumulator while the main valve 56 is opened. During this interval, there is sufficient leakage through the venting orifice 82 that accumulator-recharging is effectively blocked. Only when the pressure in cylinder space 80 has decayed sufficiently to allow the main valve 56 to reclose can effective recharging of the accumulator by the pump begin. In this respect, when the movable main valve member 62 returns to its closed position, the venting orifice 82 is effectively isolated from the accumulator, and recharging can then be effected without interference from leakage through the venting orifice 82.

Figure 4:
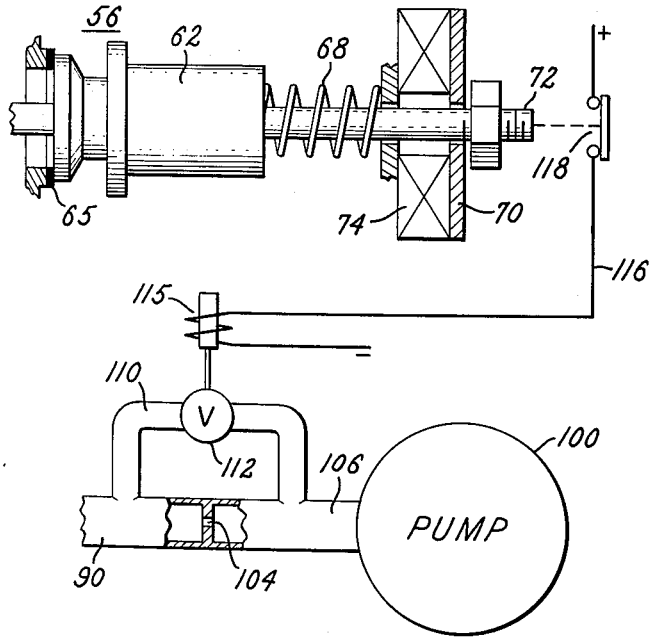
FIG. 4 is a schematic view of a portion of the hydraulic operating system and illustrating another modified embodiment thereof.

The time required for completing a recharging operation can be shortened by providing means for effectively disabling, or removing, the restriction 104 when the movable main valve member 62 is in its closed position. In a modified form of the invention shown in FIG. 4, this result is accomplished by providing a by-pass 110 around the orifice 104 and an electroresponsive valve 112 in this by-pass. This valve 112 is held open when the main valve member 62 is in closed position by current supplied to a solenoid operator 115 through an energizing circuit 116 that includes a switch 118 on the operating rod 72 of the main valve. As a result of this then-unrestricted by-pass around the restriction 104, the restriction is effectively disabled and the pump 100 can supply pressurized fluid to the system at a relatively high rate via valve 112. On the other hand, when the main valve is displaced from its closed position of FIG. 1, the switch 118 is open, the solenoid 115 is deenergized, and valve 112 is in its closed position. As a result during this interval when the main valve 56 is open, all flow from the pumping means 100 into the duct 90 must be through the restriction 104. This results in flow from the pump into the duct 90 being so small that effective charging of the accumulator is prevented, for the same reason as explained in connection with FIG. 1.

CIRCUIT-BREAKER CLOSING

A circuit-breaker closing operation is effected simply by releasing latch 20 to allow the operating rod 34, 36 and piston 32 to be driven upwardly from its position of FIG. 2 by closing spring 17. This upward motion of the operating rod 34, 36 produces only a very limited pressure buildup in the space 80 above the piston 32 because this space 80 is then freely vented through orifice 82 since the valve means 55 is then in its position of FIG. 1. This limitation on pressure buildup above piston 32 enables the movable main valve member 62 to remain seated in its position of FIG. 1 while the piston moves upwardly through a circuit-breaker closing stroke. This is important since unseating of the movable main valve member would allow high-pressure liquid from the accumulator to flow past the main valve into the actuating space 80 and thus block continued circuit-breaker closing, which is intolerable if it is desired to perform a complete closing operation.

To assist the spring 17 in providing force for circuit-breaker closing, a small auxiliary piston 84' is provided on an extension 85 at the lower end of the operating rod 36. This auxiliary piston 84' is formed by reducing the diameter of the extension 85 at a location within an auxiliary cylinder 86 so that the extension 85 has a larger diameter portion slidable within an upper sealed bore 87 than its lowermost portion, which is slidable within a lower sealed bore 88. During a circuit-breaker closing operation, the cylinder 86 is at the same pressure as liquid in the accumulator 50 by reason of a duct 90 that affords free communication between auxiliary cylinder 86 and the accumulator 50 at the upstream side of valve seat 65. Accordingly, when latch 20 is released at the start of a closing operation, pressurized liquid from the accumulator 50 acts on piston 84' to help drive the operating rod 34, 36 upwardly to effect contact-closing.

Proper closing speed can be attained by appropriately sizing the area of auxiliary piston 84' and the area of venting orifice 82 leading from the space 80 above main piston 32. But the area of venting orifice 82 should be sufficiently large to limit the pressure build-up in space 80 sufficiently to prevent it from unseating the main valve member 62 during closing, as above described.

Following a closing operation, the contacts are held in closed position by upwardly-acting force from the auxiliary piston 84' as well as from the closing spring 17. It is to be noted that the auxiliary piston 84' does not significantly interfere with the previously-described high-speed opening operation because it is small compared to main piston 32. Since roughly equal pressures are acting on these two pistons, the downward force developed on the main piston 32 during opening far exceeds the upward force developed on auxiliary piston 84' during this interval.

Although we have shown both a closing spring 17 and an auxiliary fluid motor 84', 86 being used for supplying closing force and hold-closed force, it is to be understood that either of these devices, if appropriately sized, could be used alone and without the other for this purpose.

TRIP-FREE OPERATION

If the circuit breaker is closed on a fault (i.e., when the line 16 has a fault thereon), it is important that the circuit breaker be capable of immediately reopening without delay to clear the fault. In the illustrated circuit breaker, such immediate reopening (or trip-free operation) is effected simply by opening the main valve 56. This admits high pressure liquid from the accumulator 50 to the cylinder space 80 above the piston 32, causing a rapid build-up of pressure in the cylinder space, just as previously described in connection with a normal opening operation. Since the piston 32 is much larger than the auxiliary piston 84', the pressure build-up above piston 32 quickly develops a large downwardly-acting force that immediately overcomes the upwardly acting force from the auxiliary piston and spring 17, thus immediately effecting the desired opening operation.

To assure that the desired opening force will be available for such a trip-free operation, suitable electrical interlock means (not shown) is provided to prevent initiation of a closing operation unless the accumulator 50 is substantially fully charged.

MODIFICATION OF FIG. 3

Figure 3:
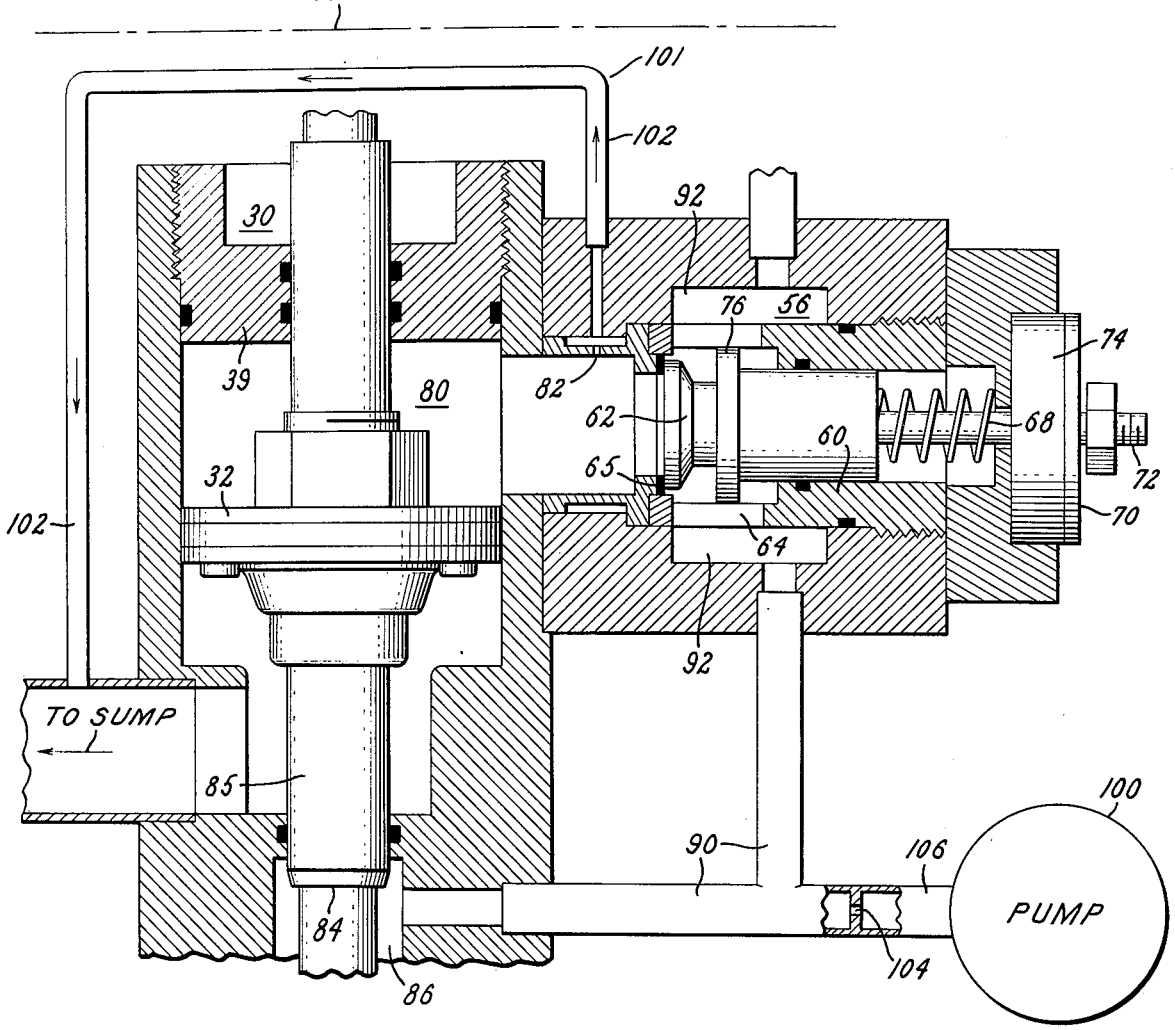
FIG. 3 is a view similar to that of FIG. 1 but showing a modified embodiment of the invention.

The typical hydraulic operating system for a circuit breaker utilizes a three-way control valve; and the valve 55 of FIG. 1 may be thought of as a valve of this type in view of the inclusion therein of the auxiliary valve 58, with its movable valve member 84 coupled to the movable main valve member 62. FIG. 3 shows how a simple two-way valve can be used instead of a three-way valve for controlling the hydraulic system. The valve of FIG. 3 is essentially the same as the valve of FIG. 1 except that the movable auxiliary valve member 84 and the rod portion 72*a* connecting it to the movable main valve member 62 have been omitted. Another modification present in the system of FIG. 3, and an important one, is that flow control means 101 is provided for controlling flow through the orifice 82. This flow control means 101 comprises a long tube 102 of restricted cross-sectional area that is connected hydraulically in series with the venting orifice 82 between the actuating space 80 and the low pressure sump.

When the system is in its at-rest position of FIG. 3, the tube 102 is filled with liquid at substantially the pressure of the sump, which is typically one atmosphere. Under these conditions, tube 102 maintains the pressure on opposite sides of the piston at substantially sump pressure. Any leakage past the closed valve member 62 will be vented to the sump through vent 82 and tube 102 to prevent the pressure in actuating space 80 from rising substantially above sump pressure. It is to be understood that the sump's liquid level (shown at 103) is high enough to keep the components of the system, including tube 102, filled with liquid.

As soon as the valve member 62 is opened to initiate a circuit-breaker opening operation, the pressure in the actuating space 80 rapidly rises. However, it takes a relatively long time for the column of liquid present in the tube to accelerate in response to this pressure rise because of its inertia and the friction effects of the long, small-cross-section tube on the column of liquid. Before such acceleration can increase to a level that produces any appreciable flow of liquid through tube 102, the piston 32 has already been moved downwardly through most of its opening stroke, preferably separating the contacts by about 75% of the nominal full gap therebetween. The amount of leakage through the tube 102 is so small during this short period (of 2 or 3 milliseconds) that such leakage does not significantly detract from the development of pressure in the actuating space following opening of valve member 62 and, correspondingly, does not introduce any significant delay in downward motion of the piston through the major portion of its opening stroke (as compared to that produced if no vent is present in the actuating space 80).

By way of example and not limitation, a tube 102 suitable for this application will have a length of between 30 and 60 inches and a geometrical cross-sectional area of between 0.1 to 0.4 square inches.

As in the embodiment of FIG. 1, when the piston 32 decelerates in response to the dashpotting effect occurring near the end of its above-described opening stroke, the pressure in the actuating space 80 rises; and this increased pressure accelerates venting through tube 102.

After the circuit-breaker opening operation has been substantially completed, the sustained pressure within the actuating space has had an opportunity to accelerate the liquid column in the tube 102, greatly increasing the flow therethrough. This increased flow effects a rapid discharge of the remaining liquid in the accumulator 50 and thus causes a prompt decay in the pressure in the actuating space 80. When this pressure falls to a predetermined level, the valve-closing spring 68 drives the movable valve member 62 back into its closed position of FIG. 3.

The length and the effective cross-sectional area of the long restricted tube 102 and the small restriction 104 in the line 90 are sized such that when the movable valve member 62 is open, there is no pressure build-up by the pump 100 in the actuating space 80 and there is no charging of accumulator 50. In effect, during this period, if the pump is operating, leakage through the tube 102 is occurring at a higher rate than liquid is being pumped through the restriction 104. The resultant pressure drop allows the valve member 62 to reset to its closed position, after which the accumulator is quickly charged by the pump.

Once the accumulator is charged, closing can be started by simply releasing latch 20 to allow the piston 32 to move upwardly within the cylinder 38 under the influence of the closing means 17 and 84, 86. The liquid displaced by the piston 32 from the space 80 as the piston moves upwardly during closing is forced through the tube 102 to the sump. The length and effective cross-sectional area of tube 102 are sized such that proper closing speed is achieved by limiting the pressure build-up above the piston to a predetermined low value. This value is sufficiently low to prevent such pressure from opening the then-closed valve member 62, which characteristic is important for reasons previously mentioned. Limiting the pressure to this level during circuit-breaker closing is not difficult inasmuch as closing is a relatively slow operation. In one embodiment, for example, the closing speed is only about 10 to 15% of the opening speed.

On circuit-breaker opening, liquid is flowing into the actuating space 80 at such a high rate and opening motion of the piston 32 takes place so quickly that any leakage through tube 102 that does occur during the short interval required for the piston to complete most of its opening stroke is so small that it does not substantially detract from the pressure development within the actuating space during this interval (as compared to that occurring if no vent is present in actuating space 80). Stated another way, this very small leakage does not introduce any substantial delay in opening motion of the piston during this short interval (as compared to opening motion produced if no vent is present in actuating space 80).

GENERAL DISCUSSION

It will be apparent from the above description that we are able to quickly reset our operating system after a circuit-breaker opening operation without need for any extra pilot device, such as a pilot valve, requiring operation to command the movable main valve member 62 to return to its closed position of FIG. 1. As explained hereinabove, at the end of a circuit-breaker opening operation, when the pressure in the piston-actuating space 80 above piston 32 decays (as a result of leakage through venting orifice 82 and the limited capacity of the accumulator 50), the movable main valve member 62 immediately resets to its closed position. Such resetting occurs promptly after circuit-breaker opening since the pressure in operating space 80 decays promptly after circuit-breaker opening. The only external control signal required for this sequence of events is the initial starting signal supplied to repulsion coil 74.

Hydraulic circuit-breaker closing is achieved without any additional valve beyond that used for circuit-breaker opening. All that is needed in our system to initiate such closing is tripping of the latch 20, which allows closing to proceed under the bias of closing spring 17 and the small fluid motor 84', 86 at the lowermost end of the operating rod.

A trip-free operation can be effected, as described hereinabove, essentially without any extra components in the operating system beyond those needed for a normal opening operation. All that is required is to open the main valve 56 that is used for normal opening, and the resulting pressure build-up above the operating piston 32 quickly overcomes the closing force to initiate an opening operation. Since the closing force produced in fluid motor 84', 86 used for closing is very small compared to the opening force developed above opening piston 32, it is unnecessary to provide the usual dump valve for the closing motor, which is typically relied upon to dump pressurized fluid therefrom during trip-free opening.

It will also be apparent from FIG. 3 and its detailed description that the above-described operation and automatic resetting of the hydraulic system without reliance on a pilot valve can be effected with a two-way valve and does not require a three-way valve if the system is constructed as shown in FIG. 3.

In the drawings, the interrupting portion of the circuit breaker (i.e., contact structure 12, 14) has been shown schematically only. In a preferred form of the invention, this interrupting structure is constituted by one or more vacuum-type circuit interrupters, such as disclosed for example in U.S. Pat. Nos. 3,462,572-Sofianek or 3,246,979-Lafferty et al. In referring hereinabove to preventing effective leakage through the vent 82 until the actuating piston 32 has moved through most of its opening stroke, we are referring to operation of our hydraulical operating system when used with one or more vacuum interrupters. A vacuum interrupter is characterized by an exceptionally short stroke, and it is not difficult to delay effective leakage through vent 82 for the short period (2 or 3 milliseconds) required to complete most of the opening stroke. It is to be understood, however, that our invention in its broader aspects is not limited to use in operating systems for vacuum interrupters. It may also be used with other types of interrupters, such as oil interrupters or gas blast interrupters, including those of the puffer type, such as shown for example in U.S. Pat. Nos. 3,739,125-Noeske or 3,602,670-Teijeiro.

Typically, non-vacuum interrupters have a much longer stroke than vacuum interrupters, and when our operating system is used for such non-vacuum interrupters, effective leakage through the vent 82 will occur during an opening operation ahead of the time the piston has reached the midpoint in its opening stroke. Effective leakage through the vent 82 is, however, delayed until the piston 32 has moved through a substantial portion of its opening stroke, e.g., about 20 percent, so as to give sufficient opportunity for the piston to have been accelerated to an effective opening speed. The instant when effective leakage begins can be advanced or delayed in the embodiment of FIG. 3 by appropriately sizing the length and diameter of the tube 102, and this is so whether the operating system is used with a non-vacuum interrupter, such as a puffer-type interrupter, or a vacuum-type interrupter. This effective leakage slows down piston movement somewhat during the subsequent portion of the opening stroke, but this is not a significant disadvantage when the operating system is used for an application that does not require extra-high opening speeds. The typical circuit breaker, whether vacuum or non-vacuum, does not, as a matter of fact, require extra-high speeds. For example, with a puffer-type circuit breaker an opening time of one or two cycles is adequate.

Our operating system when used with one or more vacuum interrupters does, however, have the capability of achieving opening times of one-half cycle or even less. Such extra-high speeds enable us to use our operating system in a vacuum circuit breaker to achieve current-limiting interrupting action, or first current-zero interruption, or the exceptionally fast performance needed for typical high voltage d.c. circuit breakers of the commutated-capacitor type.

As an indication of the difference in performance characteristics of a vacuum circuit breaker and a puffer-type gas-blast circuit breaker, it is noted that the vacuum circuit breaker typically has a stroke of about one inch or even less, whereas the puffer circuit breaker typically has a stroke of 6 to 10 inches. This difference clearly makes the vacuum-type interrupter much more suitable than the puffer-type interrupter for extra-high speed circuit breakers.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. In a hydraulically-actuated operating system for an electric circuit breaker, (a) a fluid motor comprising a cylinder and a movable piston adapted to move in an opening direction within said cylinder to open said circuit breaker and in a reverse direction within said cylinder during closing of said circuit breaker, (b) an accummulator for supplying pressurized liquid to a piston-actuating space within said cylinder, (c) a normally-closed valve located hydraulically between said accumulator and said actuating space and openable to establish communication between said accumulator and said actuating space so that pressurized liquid from said accumulator can flow through said valve to said actuating space to drive said piston in an opening direction, said valve comprising a movable valve member that is movable from a valve-closed to a valve-open position to open said valve and is returnable to said valve-closed position to close said valve, (d) a vent located hydraulically downstream of said valve with respect to said accumulator for affording communication between said actuating space and a low pressure region, (e) flow control means for restricting leakage through said vent to a rate that prevents said leakage from substantially detracting from the development of pressure within said actuating space during the period from initial opening of said valve to the time when said piston has moved through a substantial portion of its opening stroke, said flow control means acting following such period and while said valve is still open to allow effective leakage through said vent, (f) said accumulator having a limited capacity that results in the pressure within said actuating space decaying promptly to a low value as a result of effective leakage through said vent shortly after said piston has moved through a circuit-breaker opening stroke and while said movable valve member is in its valve-open position, and (g) means for restoring said movable valve member to its closed position in response to said pressure decay in said actuating space.

2. The operating system of claim 1 in which said flow control means comprises a long restricted tube hydraulically in series with said vent between said actuating space and said low pressure region for containing a column of liquid which must be accelerated to allow effective leakage through said vent.

3. The operating system of claim 2 in which during circuit-breaker opening said tube allows substantial acceleration of said column of liquid to occur only after said piston has moved through a substantial portion of its opening stroke.

4. The operating system of claim 1 in which:

(a) said piston occupies a circuit-breaker closed position when the circuit breaker is closed and a circuit-breaker open position when the circuit breaker is open, (b) releasable latching means is provided for holding said piston in said circuit-breaker open position after a circuit-breaker opening operation, (c) closing means is provided operable upon release of said latching means for returning said piston to its circuit-breaker closed position, and (d) said vent is sufficiently unrestricted when said valve is closed to allow pressurized liquid ahead of said piston during its return motion to circuit-breaker closed position to be exhausted from said actuating space without developing sufficient pressure to actuate said valve member out of its valve-closed position.

5. The operating system of claim 1 in combination with:

(a) pumping means operable to supply pressurized liquid to said accumulator for recharging said accumulator, (b) means for causing said pumping means to operate when the pressure in said accumulator is below a predetermined level, thereby supplying pressurized liquid to said accumulator, and (c) a restriction hydraulically between said pumping means and said accumulator that limits the rate at which the pumping means supplies liquid to said accumulator sufficiently so that accumulator-recharging is prevented while said valve member is in valve-open position and effective leakage is occurring through said vent.

6. The operating system of claim 5 in combination with means for effectively disabling said restriction while said main valve member is in valve-closed position, thereby increasing the rate at which said pumping means supplies pressurized liquid to said accumulator when said main valve is closed.

7. The operating system of claim 2 in combination with:

(a) pumping means operable to supply pressurized liquid to said accumulator for recharging said accumulator, (b) means for causing said pumping means to operate when the pressure in said accumulator is below a predetermined level, thereby supplying pressurized liquid to said accumulator, (c) a restriction hydraulically between said pumping means and said accumulator that limits the rate at which the pumping means supplies liquid to said accumulator sufficiently so that accumulator-recharging is prevented while said valve member is in valve-open position and effective leakage is occurring through said vent.

8. The operating system of claim 1 in which:

(a) said valve constitutes a main valve and said movable valve member constitutes a movable main valve member, (b) said vent affords free communication between said actuating space and said low pressure region when said main valve is closed, (c) said flow control means comprises an auxiliary valve member coupled to said movable main valve member and arranged to restrict flow through said vent when said movable main valve member is moved into its valve-open position, thereby accelerating pressure build-up within said actuating space when pressurized liquid flows thereinto from said accumulator, (d) said auxiliary valve member allows a limited amount of leakage through said vent when said movable main valve member is in its valve-open position, and (e) restoration of said movable main valve member to its closed position restores free communication through said vent between said actuating space and said low pressure region.

9. The operating system of claim 1 in combination with dashpotting means for said piston effective near the end of said opening stroke for decelerating said piston thereby to cause near the end of said opening stroke a pressure rise in said actuating space that accelerates leakage flow through said vent.

10. The operating system of claim 1 in which said accumulator has sufficient capacity to complete only one full opening operation of the circuit breaker without being recharged.

11. In a hydraulically-actuated operating system for an electric circuit breaker, (a) a fluid motor comprising a cylinder and a movable piston adapted to move in an opening direction within said cylinder to open said circuit breaker and in a reverse direction within said cylinder during closing of said circuit breaker, (b) an accumulator for supplying pressurized liquid to an actuating space within said cylinder, (c) a normally-closed main valve located hydraulically between said accumulator and said actuating space and openable to establish communication between said accumulator and said actuating space so that pressurized liquid from said accumulator can flow through said valve to said actuating space to drive said piston in an opening direction, said main valve comprising a movable main valve member that is movable from a valve-closed to a valve-open position to open said main valve and is returnable to said valve-closed position to close said main valve, (d) a vent located hydraulically downstream of said main valve with respect to said accumulator for affording free communication between said actuating space and a low pressure region when said main valve is closed, (e) an auxiliary valve member coupled to said movable main valve member and arranged to restrict flow through said vent when said movable main valve member is moved into its valve-open position, thereby accelerating pressure build-up within said actuating space, (f) said auxiliary valve member allowing a limited amount of leakage through said vent when said movable main valve member is in its valve-open position, (g) said accumulator having a limited capacity that results in the pressure within said actuating space decaying promptly to a low value as a result of leakage through said vent shortly after said piston has moved through a circuit-breaker opening stroke and while said movable main valve member is in its valve-open position, and (h) means for restoring said movable main valve member to its closed position in response to said pressure decay in said actuating space, thereby restoring free communication through said vent between said actuating space and said low pressure region.

12. The operating system of claim 11 in which:

(a) said piston occupies a circuit-breaker closed position when the circuit breaker is closed and a circuit-breaker open position when the circuit breaker is open, (b) releasable latching means is provided for holding said piston in said circuit-breaker open position after a circuit breaker-opening operation, (c) closing means is provided operable upon release of said latching means for returning said piston to its circuit-breaker closed position, and (d) said vent is sufficiently unrestricted when said main valve is closed to allow pressurized liquid ahead of said piston during its return motion to circuit-breaker closed position to be exhausted from said actuating space without developing sufficient pressure to actuate said main valve member out of its valve-closed position.

13. The operating system of claim 11 in combination with:

(a) pumping means operable to supply pressurized liquid to said accumulator for recharging said accumulator, (b) means for causing said pumping means to operate when the pressure in said accumulator is below a predetermined level, thereby supplying pressurized liquid to said accumulator, and (c) a restriction hydraulically between said pumping means and said accumulator that limits the rate at which the pumping means supplies liquid to said accumulator sufficiently so that accumulator-recharging is prevented while said main valve member is in valve-open position and leakage is occurring through said vent.

14. The operating system of claim 12 in combination with:

(a) pumping means operable to supply pressurized liquid to said accumulator for recharging said accumulator, (b) means for causing said pumping means to operate when the pressure in said accumulator is below a predetermined level, thereby supplying pressurized liquid to said accumulator, (c) a restriction hydraulically between said pumping means and said accumulator that limits the rate at which the pumping means supplies liquid to said accumulator sufficiently so that accumulator-recharging is prevented while said main valve member is in valve-open position and leakage is occurring through said vent.

15. The operating system of claim 11 in which said accumulator has sufficient capacity to complete only one full opening operation of the circuit breaker without being recharged.

16. The operating system of claim 1 in which during a circuit-breaker opening operation said flow control means allows effective leakage through said vent only after said piston has moved through most of its stroke.

17. The operating system of claim 2 in which during circuit-breaker opening said tube allows substantial acceleration of said column of liquid to occur only after said piston has moved through most of its opening stroke.

18. The operating system of claim 3 in which said accumulator has sufficient capacity to complete only one full opening operation of the circuit breaker without being recharged.

* * * * *